US005356493A

United States Patent [19]

Tsuyama et al.

[11] Patent Number: 5,356,493

[45] Date of Patent: Oct. 18, 1994

[54] BLISTER-RESISTANT STEEL SHEET AND METHOD FOR PRODUCING THEREOF

[75] Inventors: Seishi Tsuyama; Yoshihiro Hosoya; Shuji Kanetoh; Daijiro Koyanagi; Hiromi Nakamura; Satoshi Kohira, all of Kawasaki, Japan

[73] Assignee: NKK Corporation, Tokyo, Japan

[21] Appl. No.: 86,507

[22] Filed: Jul. 1, 1993

[30] Foreign Application Priority Data

Jul. 8, 1992 [JP] Japan ..... 4-203168

[51] Int. Cl.[5] ..... C21P 8/04; C22C 38/06

[52] U.S. Cl. ..... 148/320; 148/518; 148/537; 148/663; 420/126

[58] Field of Search ..... 420/126; 148/320, 518, 148/537, 663

[56] References Cited

U.S. PATENT DOCUMENTS

| | | | |
|---|---|---|---|
| 3,765,874 | 10/1973 | Elias et al. . | |
| 4,011,111 | 3/1977 | Hook . | |
| 4,504,326 | 3/1985 | Tokunaga et al. | 148/320 |
| 4,586,966 | 5/1986 | Okamoto et al. . | |
| 4,750,952 | 6/1988 | Sato et al. | 148/320 |
| 5,041,166 | 8/1991 | Matsuoka et al. | 148/320 |

FOREIGN PATENT DOCUMENTS

| | | |
|---|---|---|
| 0112027 | 6/1984 | European Pat. Off. . |
| 0171208 | 2/1986 | European Pat. Off. . |
| 0228756 | 7/1987 | European Pat. Off. . |
| 0295697 | 12/1988 | European Pat. Off. . |
| 0421087 | 4/1991 | European Pat. Off. . |
| 0444967 | 9/1991 | European Pat. Off. . |
| 0484960 | 5/1992 | European Pat. Off. . |
| 2115327 | 7/1972 | France . |
| 44-18066 | 8/1969 | Japan . |
| 54-1245 | 1/1979 | Japan . |
| 59-67319 | 4/1984 | Japan . |
| 2234985 | 2/1991 | United Kingdom . |

*Primary Examiner*—Deborah Yee

*Attorney, Agent, or Firm*—Frishauf, Holtz, Goodman & Woodward

[57] ABSTRACT

Blister-resistant steel sheet consists essentially of 0.0005 to 0.003 wt. % C, 0.10 to 2.2 wt. % Mn, 0.6 wt. % or less Si, 0.07 wt. % or less P, 0.025 wt. % or less S, 0.02 to 0.06 wt. % of sol. Al, 0.0035 wt. % or less N, 0.003 wt. % or less O, [(48/14)N+(48/32)S+4×(48/12)C] wt. % or less Ti and the balance being Fe and inevitable impurities; and smaller one of either Ti (wt. %) or [(48/14)N+(48/32)S] (wt. %) being [0.002 $t^2$+0.003] or more, where t is a thickness (mm) of the steel sheet. Method for producing blister-resistant steel sheet comprises preparing a cold rolled steel sheet having the composition of described above, and continuously annealing or continuous hot dip galvanizing by heating the steel sheet from room temperature to 650°-720° C. at a rate of 20° C. sec or more and further to the soaking temperature above recrystallization temperature at a rate of 1°-5° C./sec.

20 Claims, 4 Drawing Sheets

BLISTER-RESISTANT STEEL SHEET AND METHOD FOR PRODUCING THEREOF

BACKGROUND OF THE INVENTION

1. Field of the Invention

The present invention relates to a blister-resistant steel sheet applied to automobiles and household electric appliances and to a method for producing thereof. In particular, the present invention relates to a blister-resistant steel sheet using extremely low carbon steel as the body material and a method for producing thereof.

2. Description of the Related Arts

Recent development of the technology of steel making and of degassing allowed the commercial production of extremely low carbon steels containing 50 ppm or less of carbon and nitrogen at a relatively low cost. By adding Ti and Nb, which form carbide and nitride, to the extremely low carbon steel, what is called "IF steel" (carbon and nitrogen are fixed in the steel) was produced. The IF steel was introduced in JP-B-44-18066, JP-B-54-1245, and JP-A-59-673 19 (the terms "JP-B-" and "JP-A-" referred to herein signify "examined Japanese patent publication" and "unexamined Japanese patent publication", respectively). The IF steel is widely used in cold rolled steel sheets which need good formability mainly with respect of deep drawing.

Compared with common low oxygen Al-killed steel, however, that type of IF steel likely generates blisters after the final heat treatment. A blister is a rounded swelling on the surface of metal of an approximate size of 1 mm in width and 10 mm in length. Thicker steel sheet induces blisters more easily. Since a blister bursts open during the processing such as press-forming, it is classified as a surface defect. If any blister is found on the product steel sheet at manufacturer's product inspection, the steel sheet is rejected.

Accordingly, compared with the frequency of blisters generation in manufacture line, the frequency for users to deal with the blister as a serious problem is not necessarily high. As a result, very few papers and patents deal with the blister on IF steel. Nevertheless, for the material manufacturers, the generation of blisters results in a significant decrease of production yield, and particularly when some blisters which could not be found during a user's inspection burst open during the processing such as press-forming, the defect in the processing results in the reduction of productivity.

SUMMARY OF THE INVENTION

The object of the present invention is to provide a blister-resistant steel sheet and a method for producing thereof.

To achieve the object, the present invention provides a blister resistant steel sheet consisting essentially of: 0.0005 to 0.003 wt. % C, 0.10 to 2.2 wt. % Mn, 0.6 wt. % or less Si, 0.07 wt. % or less P, 0.025 wt. % .or less S, 0.02 to 0.06 wt. % sol. Al, 0.0035 wt. % or less N, 0.003 wt. % or less O, (48/14)N +(48/32)S=4×(48/12)C] wt. % or less Ti and the balance being Fe and inevitable impurities; and smaller one of either Ti (wt. %) or [(48/14)N +(48/32)S] (wt. %) being [0.002 $t^2$+0.003] or more, where t is a thickness (mm) of the blister-resistant steel sheet.

Further the present invention provides a method for producing a blister-resistant cold rolled steel sheet, which method comprises:

preparing a cold rolled steel sheet consisting essentially of 0.0005 to 0.003 wt. % C, 0.10 to 2.2 wt. % Mn, 0.6 wt. % or less Si, 0.07 wt. % or less P, .0.025 wt. % or less S, 0.02 to 0.06 wt. % sol. Al 0.0035 wt. % or less N, 0.003 wt. % or less 0, [(48/14)N +(48/32)S +4×(48/12)C] wt. % or less Ti, and the balance being Fe and inevitable impurities; and smaller one of either Ti (wt. %) or [(48/ 14)N+(48/32)S] (wt. %) being [0.002 $t^2$+0.003] or more, where t is a thickness (mm) of the steel sheet; and continuously annealing the cold rolled steel sheet by heating the steel sheet from room temperature to 650°–720° C. at a rate of 20° C./sec or more and further to the soaking temperature above the recrystallization temperature at a rate of 1°–5° C./sec.

Further the present invention provides a method for producing a blister-resistant zinc hot dip galvanizing steel sheet, which method comprises:

preparing a cold rolled steel sheet consisting essentially of 0.0005 to 0.003 wt. % C, 0.10 to 2.2 wt. % Mn, 0.6 wt. % or less Si, 0.07 wt. % or less P, 0.025 wt. % or less S, 0.02 to 0.06 wt. % sol. Al, 0.0035 wt. % or less N, 0.003 wt. % or less O, [(48/14)N +(48/32)S+4+(48/12)C] wt. % or less Ti, and the balance being Fe and inevitable impurities; and smaller one of either Ti (wt. %) or [(48/14)N+(48/32)S] (wt. %) being [0.002$t^2$+0.003] or more, where t is a thickness (ram) of the steel sheet; and continuously hot dip galvanizing by heating the steel sheet from room temperature to 650°–720° C. at a rate of 20° C./sec or more and further to the soaking temperature above the recrystallization temperature at a rate of 1°–5° C./sec.

DESCRIPTION OF THE PREFERRED EMBODIMENT

The inventors investigated the mechanism of blister generation and the countermeasures against blistering, and optimized the composition of steel to obtain a steel sheet having excellent blister resistance. Regarding the blister defects, the inventors clarified the followings.

Figure 6:
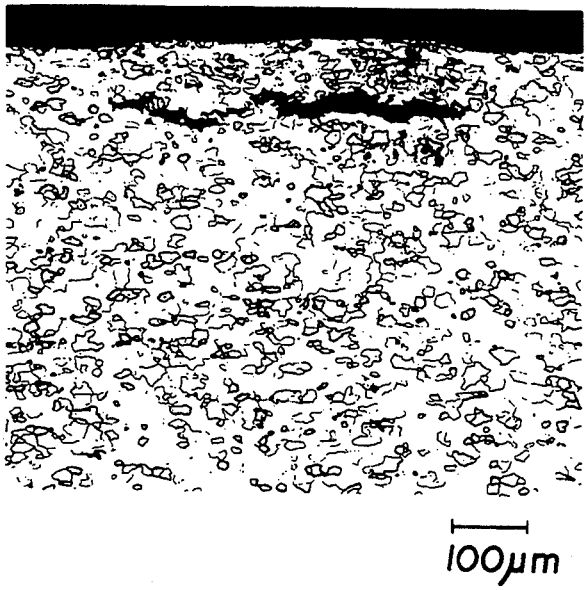
FIG. 6 is a microscopic photograph (×100) showing a typical blister on IF steel sheet observed on the section lateral to rolling direction.
Figure 7:
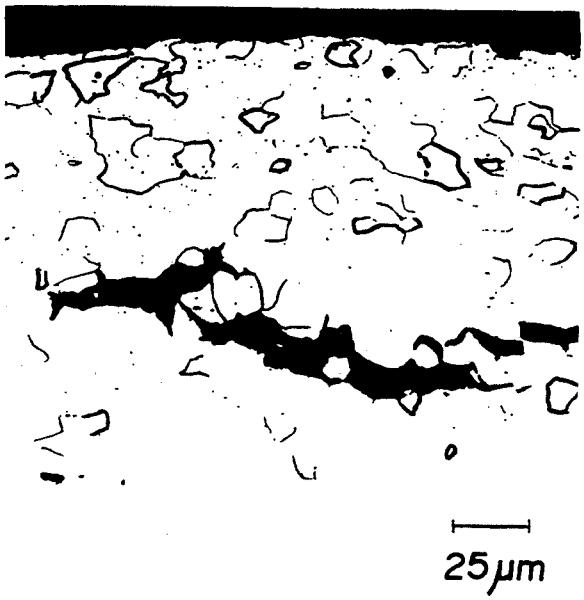
FIG. 7 is a microscopic photograph (×400) of blister on the same IF steel sheet as used in FIG. 6.

The blister defect is a rounded swelling on the surface of metal caused by the crack which started from $Al_2O_3$ being located at a depth around 0.1 to 0.2mm from the surface and which developed parallel to the sheet surface plane. When this type of $Al_2O_3$ exists in a cluster shape, blister defect occurs even if the steel is not the one with extremely low carbon content. However, in the case that secondary oxidized $Al_2O_3$ is distributed in a form of scattered islands of several microns to submicron in each size, blister defect occurs in an extremely low carbon steel. The cause of blister defect is, as shown in FIG. 6 and FIG. 7, the depletion of solid solution carbon which has the role of strengthening the grain boundaries, which induces grain boundary cracks easily.

In concrete terms, the following steps presumably occur. Hydrogen which was concentrated to the surface layer during pickling is diffused into central region of the steel to form a solid solution. During the last stage of final heat treatment or after the treatment, atomic hydrogen is again diffused to concentrate into the deformed region generated by the difference of thermal expansion coefficient between $Al_2O_3$ and matrix interface and into the fine pores generated from the decohesion at interface caused by the cold rolling. Then, the diffused and concentrated hydrogen is gasified to increase its volume, which induces the grain boundary cracks. The tendency of increasing the frequency of defect generation with the increase in steel sheet thickness is explained by the increase of hydrogen supply in the thickness direction.

From the above described finding, the inventors concluded that the following three measures are effective to prevent the blister generation in extremely low carbon steel sheets, and based on the conclusion, this invention was completed.

(a) To reduce the amount of $Al_2O_3$ which is the initiating point of blistering.
(b) To suppress the hydrogen diffusion.
(c) To strengthen the grain boundaries which are the propagation route of cracks.

The reason why the content of elements of the invented steel is specified will now be described as follows;

C: 0.0005–0.003 wt. %

Less C content is more preferable for formability. On the other hand, C is an essential additive element for blister resistance because C strengthens grain boundaries. Consequently, the range of C content is specified to 0.0005–0.003 wt. %.

Mn: 0.1–2.2 wt. %

Since Mn plays a role of deoxidizer element, it is necessary to add Mn to reduce the amount of $Al_2O_3$ which is the initiating point of crack. Excess addition of Mn, however, results in the degradation of formability. Accordingly, the range of Mn content is specified to 0.1–2.2 wt. %.

Si: 0.6 wt. % or less

Although Si has a function to strengthen by solid solution, excess addition of Si induces the degradation of formability. Therefore, the upper limit of Si content is specified to 0.6 wt. %.

P: 0.07wt. % or less

Phosphorous has a function to strengthen by solid solution. However, excess addition of P should be avoided from the viewpoint of blister resistance because P is an element to enhance brittleness of grain boundaries. Accordingly, the upper limit of P content is specified to 0.07 wt. %.

S: 0.025wt. % or less

Excess S addition weakens grain boundaries, enhances blister generation, and induces cracks during hot rolling. Smaller content of S is more favorable, and the upper limit is specified to 0.025 wt. %.

sol. Al: 0.02–0.06 wt. %

Aluminum addition is needed to deoxidize the molten steel. However, excess addition of Al increases $Al_2O_3$ which is not favorable for the blister prevention. Accordingly, the range of sol. Al content is specified to 0.02–0.06 wt. %.

N: 0.0035wt. % or less

From the standpoint of formability, less N addition is more favorable, and the upper limit is specified to 0.0035 wt. %. Nevertheless, N and S react with Ti to precipitate to play a role of trapping site of hydrogen, which suppresses the generation of blister. Therefore, the content of combined N and Ti shall be kept in a range specified in the description of Ti given below.

O: 0.003 wt. % or less

Figure 1:
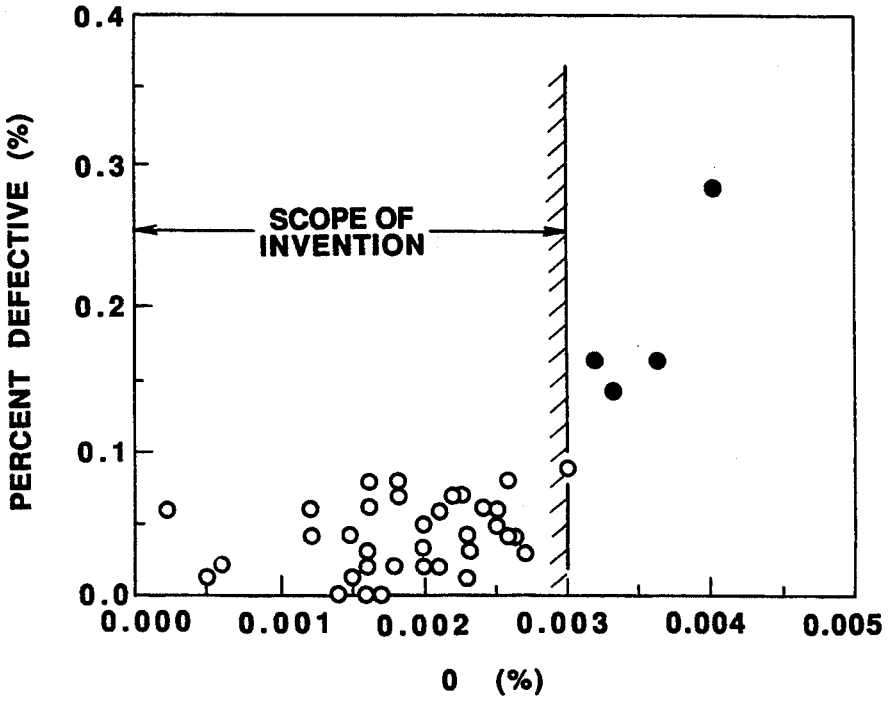
FIG. 1 is a graph which shows the relation between oxygen content of the present invention and percent defective caused by blistering.

When O addition exceeds 0.003 wt. %, the generation of blister becomes significant. The trend is clearly shown in FIG. 1 which gives the relation of oxygen content and percent defective caused by blistering. Increase of O content increases $Al_2O_3$ which causes blistering, and enhances the blister generation. Consequently, the upper limit of O content is specified to 0.003 wt. %. In FIG. 1, the symbol ○ designates No. 1 through No. 35 steel of the present invention, and the symbol ● designates No. 37 through No. 39 and No. 64 of comparative steel.

Ti:

Titanium is a useful element to fix C and N and to improve formability. To prevent blister generation, Ti is used in a form of TiN and TiS to trap hydrogen. To trap hydrogen, addition of a large amount of Ti is favorable. However, to avoid brittleness of grain boundaries, less Ti is more favorable. Accordingly, the Ti addition is specified to the amount which satisfies both equations given below.

$$\text{Ti(wt. \%)} \leqq [(48/14)N+(48/3.2)S+4\times(48/12)C]\text{wt. \%} \quad (1)$$

$$\min.[\text{Ti}, (48/14)N+(48/32)S] \geqq 0.002t^2+0.003 \quad (2)$$

where t in equation (2) is the steel sheet thickness (mm), and the expression of {min.[Ti, (48/14)N+(48/32)S]} means the smaller one of either Ti or {(48/14)N+(48/32)S}.

Figure 2:
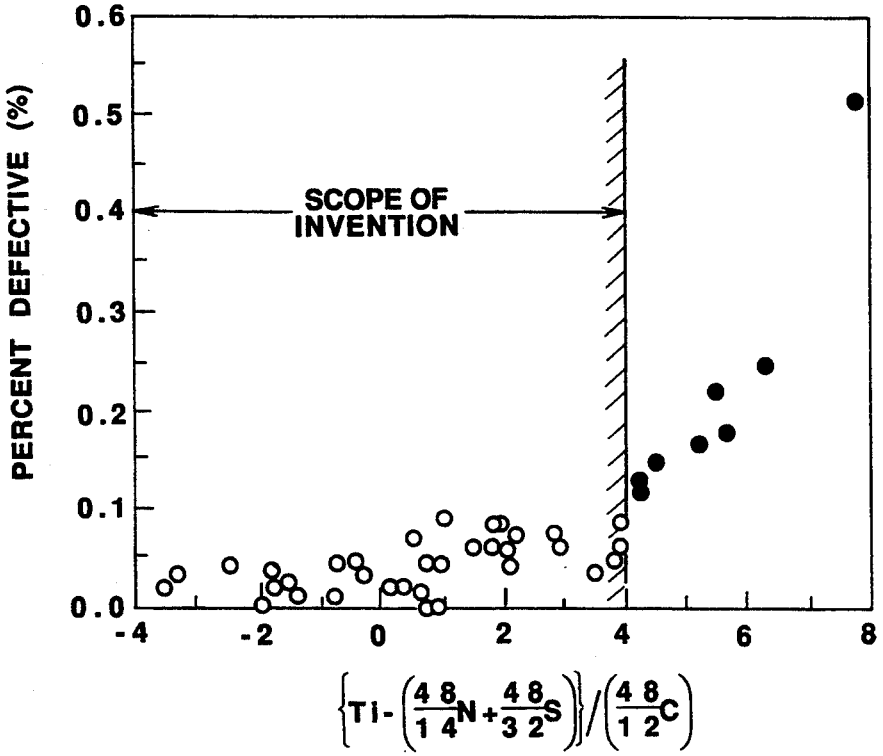
FIG. 2 is a graph which shows the relation between [Ti−{(48/14)N+(48/32)S }]/(48/12)C of the present invention and percent defective caused by blistering.

Titanium other than the one becomes to nitride and sulfide combines with C, which depletes the C in the grain boundary region and enhances blister generation. Therefore, equation (1) indicates the necessity to avoid excess addition of Ti. Stoichiometrically, Ti and C bound each other at a rate of 1:1. Actually, however, several times as much of Ti as of C, is necessary. FIG. 2 shows the frequency of blister generation as the function of [Ti−{(48/14)N+(48/32)S}]/(48/12)C. In FIG. 2, the symbol ○ designates No. 1 through No. 35 steel of the present invention, and the symbol ● designates No. 54 through No. 60, and No. 65 of comparative steel. FIG. 2 indicates that when Ti other than the one formed nitride and sulfide exceeds [4×(48/12)C], the blister generation increases rapidly. In other words, when Ti (wt. %) exceeds [(48/14)N+(48/32)S+4

×(48/12)C] (wt. %), the blister generation increases rapidly. In concrete terms, if the Ti addition is controlled to keep the amount of Ti except for that Ti which is combined with N and S, at 4 times or less of the stoichiometric amount of C, then the presence of C at grain boundary region is secured to suppress the blister generation.

Figure 3:
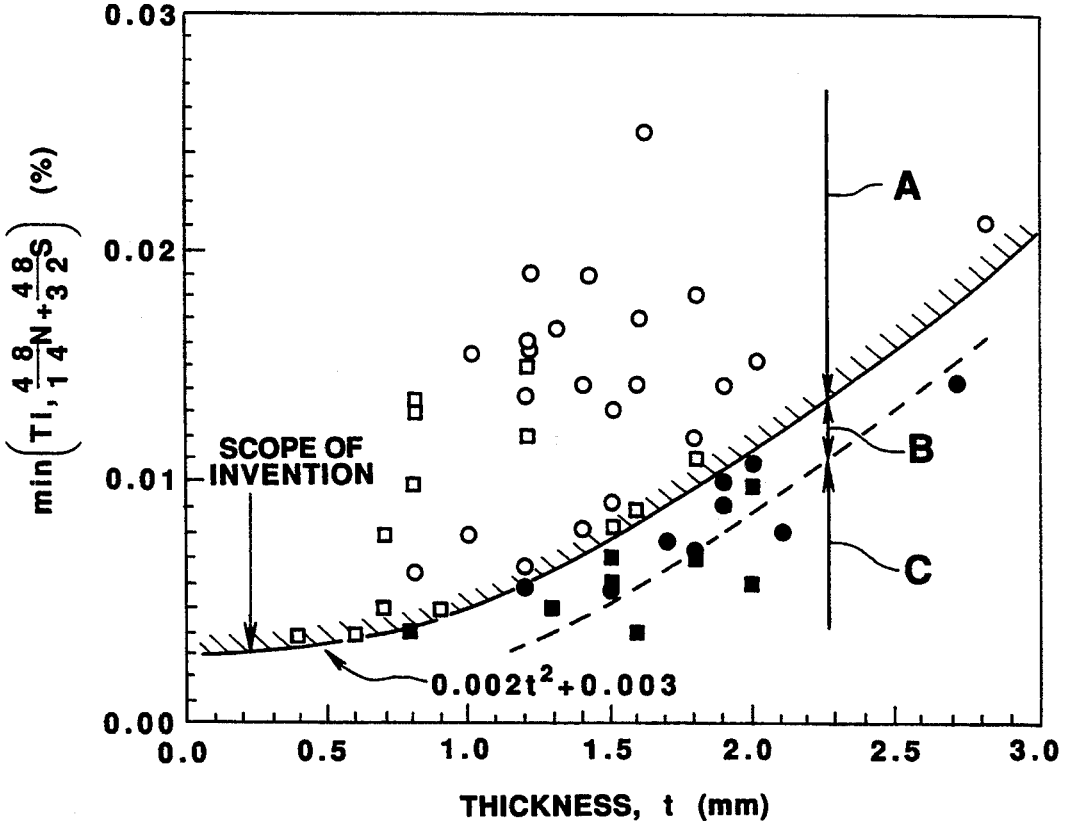
FIG. 3 is a graph which shows the relation between smaller one of either Ti wt. %) or [(48/14)N+(48/32)S] (wt%) and percent defective caused by blistering.

Equation (2) was derived after analyses of a large volume of data from various viewpoints, and was verified by laboratory experiments. Equation (2) is a core of this invention. Equation (2) indicates that when the thickness of steel sheet increases, it is necessary to increase (TiN+TiS) precipitate, not solely increase Ti addition. Accordingly, the prevention of hydrogen diffusion is important to suppress the blister generation, and the fine precipitate acts as the trapping sites. The inventors analyzed the collected data on various kinds of precipitates and found that TiN and TiS trap hydrogen more effectively. To suppress the blister generation, it is extremely important to adequately control the amount of the precipitate of these compounds responding to the thickness of steel sheet. Strictly speaking, even if the same amount of precipitate is produced, the change of production condition varies the size of precipitate and varies the surface area to trap hydrogen. The effect of manufacturing condition is, however, relatively small, and, as shown in FIG. 3, when the condition satisfies the equation (2), sufficient result is expected. In FIG. 3, the symbols of ○ and □ designate No. 1 through No. 35 of the steel of this invention, and the symbols of ● and ■ designate No. 40 through No. 53, and No. 61 through No. 63 of the comparative steel. The symbols of □ and ■ are for the case of Ti<[(48/14)N+(48/32)S], and the symbols of ◯ and  are for the case of Ti>[(48/14)N+(48/32)S]. In FIG. 3, the A zone which satisfies the condition of equation (2) gives 0.09% or less of the percent defective caused by blistering, and the B zone gives 0.12–0.19% of percent defective caused by blistering, and the C zone gives 0.21% or higher percent defective caused by blistering.

The steel sheet thickness applied to this invention is preferably in a range of from 0.3 to 3.0 mm. When the sheet thickness is less than 0.3 mm, the frequency of blister generation itself decreases, so the necessity to control chemical composition in the present invention is slight. When the sheet thickness exceeds 3.0 mm, Ti, S, and N have to be added to a great extent to secure the amount of TiN and TiS, which may degrade the surface quality.

The above described composition is the basic scheme of the present invention. Nevertheless, the present invention may further add at least one element selected from the group consisting of 0.003 to 0.03 wt. % Nb and 0.0003 to 0.0015 wt. % B.

Nb: 0.003–0.03 wt. %

Niobium fixes C and improves formability. In addition, after heat treatment, Nb makes a part of C free again. Addition of 0.003 wt. % Nb or more improves the blister resistance. However, addition of a large amount of Nb saturates the effect and degrades the formability. Consequently, the addition of Nb is preferably in a range of 0.003–0.03 wt. %.

B: 0.0003–0.0015 wt. %

Boron is an element to strengthen grain boundaries without competing against C. Addition of 0.0003 wt. % B or more gives an effect to suppress blister generation. However, excess addition of B saturates the effect and degrades the formability. Accordingly, the upper limit of B addition is specified to 0.0015 wt. %.

Figure 4:
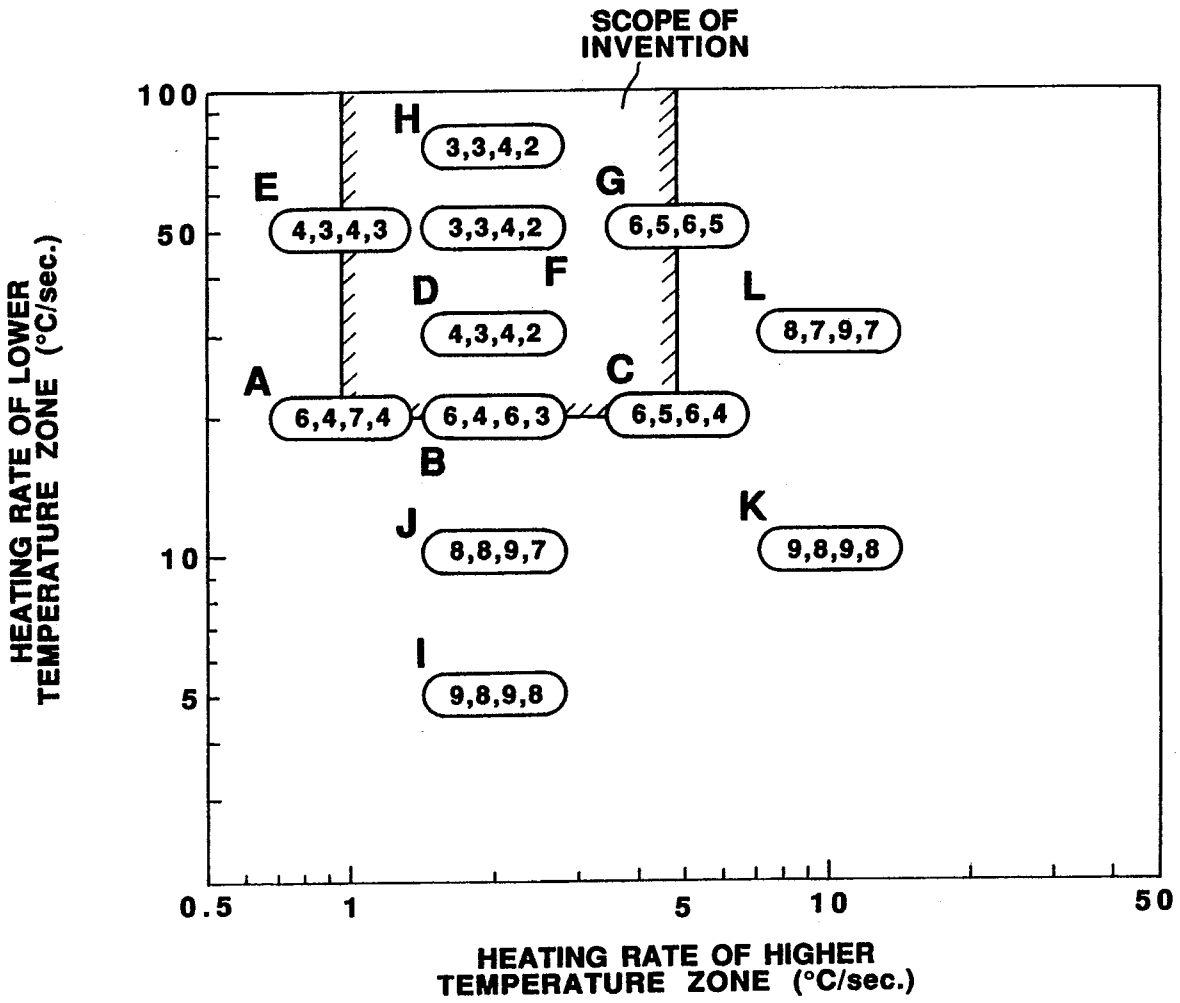
FIG. 4 is a graph which shows the relation between heating rate at the first stage and the second stage of the present invention and percent defective caused by blistering.

The following is the description of the manufacturing method. According to the manufacturing method of the present invention, the control of heating rate during annealing is an important condition. Although the detailed mechanism is not clear, the two step heating rate control suppresses the blister generation. FIG. 4 shows the relation between the percent defective caused by blistering and the heating rate at the first lower temperature zone and at the second higher temperature zone. The encircled figures in FIG. 4 designate the percent defective ($\times 10^{-2}$%) of the steel No. 20, 27, 29, and 33. The prefix alphabet at the upper left of each circle corresponds to the manufacturing condition listed on Table 4. As seen in FIG. 4, in the two step heating control process, the rapid heating at a rate of 20° C./sec or more up to 650°–720° C. is followed by the gradual heating at a rate of 1 to 5° C./sec up to the soaking temperature above the recrystallization temperature.

Hydrogen which is an element which causes blistering concentrates on the surface layer of steel sheet mainly by the reaction which occurs during pickling. A part of the hydrogen concentrated to the surface layer is emitted to atmosphere during the heating stage of annealing process. Most of the concentrated hydrogen, however, form a solid solution and diffuse to distribute in the thickness direction. When the steel sheet is rapidly heated, the steel sheet achieves a high temperature while keeping the relatively high surface hydrogen concentration, which enhances the degree of emission of hydrogen, which was concentrated to the surface layer, into the atmosphere. Nevertheless, at the temperature zone of more than 650°–720° C., the amount of the solid solution of hydrogen in the steel increases, which in turn reduces the dependency of the hydrogen emission on heating rate so that the rapid heating is no longer necessary. The temperature range which needs the rapid heating is up to 650°–720° C. On the contrary, when a rapid heating is applied in a high temperature zone, the difference of the thermal expansion coefficient of $Al_2O_3$ and the matrix induces decohesion at the interface and develops the phenomenon. In the case of gradual heating, the stress relaxation effect of the matrix suppresses the generation and development of interracial decohesion. Blister defect occurs from the diffusion and concentration of hydrogen into the decohesion portion at the final period of and after the cooling process. Consequently, from the point of suppressing the blister generation, the combination of rapid heating at the lower temperature zone and gradual heating at the higher temperature zone, which was described above, is required. To do the heating, the heating rate is limited to 20° C./sec or more up to 650°–720° C., then to 1°–5° C./sec to the soaking temperature above the recrystallization temperature. The reason why the lower limit of heating rate at the higher temperature zone is defined to 1° C./sec is that the heating rate below 1° C./sec needs a long period until the system reaches a holding temperature, which requires elongated annealing line and scale up of facilities to degrade the economy of the production line.

FIG. 1 through 4 show the data plot of embodiments. The comparative steels in FIG. 1 do not satisfy the specified range of O content of the present invention. The comparative steels in FIG. 2 do not satisfy the specified range of T wt. %≦[(48/14)N+(48/32)S+4+(48/12)C] wt. % of the present invention. The comparative steels in FIG. 3 do not satisfy the min. [Ti, (48/14)N+(48/32)S]≧(0.002t²+0.003) Of the present invention. The comparative steels in FIG. 4 do not satisfy the heating rate condition during annealing of the present invention.

The steel sheet of the present invention is prepared following a known practice by melting in a converter or electric furnace and casting, by hot rolling directly or after re-heating, and by pickling and cold rolling to set a specified thickness. The cold rolled steel sheet of the present invention includes not only the one prepared by continuous annealing but also the one prepared by cold rolling or continuous annealing followed by hot dip galvanizing or electrolytic zinc plating. Furthermore, the steel sheet of the present invention includes the one subjected to surface treatment applying at least one of organic coating and chemical conversion treatment. Zinc plating includes Zn—Alloy, Zn—Ni and Zn—Al plating.

EXAMPLE

Table 1(A) and 1(B) shows the composition of steels of the present invention, and Table 2 shows the composition of comparative steels. Table 3 lists the thickness of steels and the state of blister generation on them which are listed in Table 1(A) and 1(B) and Table 2. The basic manufacturing conditions are the following. The hot rolled steel sheets were prepared by two methods. The first method employed the continuous casting, direct hot rolling, cooling on a run-out table, and coiling. The second method employed the continuous casting, cooling to room temperature, re-heating to 1200°-1300° C., hot rolling, cooling on a run-out table, and coiling. The obtained hot rolled steel sheets gave 2.8–4.5 mm of thickness. The average finish temperature of the hot rolling was 900° C., and coiling temperature was 640° C. The obtained hot rolled steel sheets were subjected to pickling, cold rolling, continuous annealing at the temperature range of 760°-870° C., and temper rolling with a reduction of 0.5%. After the treatment above described, blister generation was investigated.

Regarding the material subjected to hot dip galvanizing, the material was treated by cold rolling, continuous annealing at 820° C., cooling to 460° C., hot dip galvanizing of 55 g/m² of coating weight per side, and being alloyed at 500° C. The Zn plated material was further treated by temper rolling with a reduction of 1.0% and by zinc coating with 80% Fe-Zn alloy of 3 g/m² of coating weight per side. As for the material subjected to electroplating steel sheet, the material was treated by temper rolling and electroplating with 88% Zn—Ni alloy of 30 g/m² of coating weight per side. For the material subjected to electroplating—organic coating, the material was treated by electroplating, then by composite coating of a chromate layer of 50g/m² of coating weight and a resin layer of 1 μm of thickness. Except for Table 4 and FIG. 5, the heating rate during the continuous annealing or continuous hot dip galvanizing was 20° C./ sec from room temperature to 700° C. and 1° C./sec from 700° C. to soaking temperature.

As the parameter for the analysis of blister generation, the length of one blister was counted as 1.5 m, and the total counted length for all the blisters was divided by the total coil length. The obtained value was taken as the percent defective caused by blistering. With the percent defective, the blister resistance was evaluated.

The mark *1 at the top right of Table 1 designates [(48/14)N+(48/32)S], and the mark *2 designates [(48/14)N+(48/32)S+4×(48/12)C]. The steels No. 3, 10, and 15 in Table 1 are the material prepared by direct hot rolling, pickling, cold rolling, continuous annealing and temper rolling. The steels No. 4, 11, 17, 27, 31, and 34 are the material prepared by re-heating and hot rolling, pickling, cold rolling, continuous annealing, hot dip galvanizing and temper rolling. The steel No. 5 is the material prepared by re-heating and hot rolling, pickling, cold rolling, continuous annealing, temper rolling and organic coating. The steels No. 6 and 32 are the material prepared by re-heating and hot rolling, pickling, cold rolling, continuous annealing, temper rolling and electroplating. Materials other than the above described were prepared by re-heating and hot rolling, pickling, cold rolling and continuous annealing.

The mark *1 at the top right of Table 2 designates [(48/14)N+ (48/32)S], and the mark *2 designates [(48/14)N+(48/32)S+4×(48/12)C]. The figure with *mark indicates that the value does not satisfy the specified range of composition of the present invention. The steels No. 37, 48, and 51 in Table 2 are the material prepared by direct hot rolling, pickling, cold rolling, continuous annealing and temper rolling. The steels No. 40, 49, and 56 are the material prepared by re-heating and hot rolling, pickling, cold rolling, continuous annealing and hot dip galvanizing and temper rolling. The steel No. 43 is the material prepared by re-heating, hot rolling, pickling, cold rolling, temper rolling, electroplating and organic coating. The steel No. 50 is the material prepared by re-heating and hot rolling, pickling, cold rolling, continuous annealing, temper rolling and electroplating. Materials other than the above described were prepared by re-heating and hot rolling, pickling, cold rolling, continuous annealing and temper rolling.

From the reasons listed below, the comparative steels gave 0.12% or more percent defective caused by blistering.

(a) The comparative steels No. 37 through 39 and No. 64 contained an increased amount of O which relates to $Al_2O_3$, the initiating point of blistering.

(b) The comparative steels No. 40 through 53 and No. 61 through 63 contained not much TiN and TiS, both of which trap hydrogen.

(c) The comparative steels No. 36, No. 54 through 60, and No. 65 lacked the solid solution of C and suffered with a weakened grain boundaries.

To the contrary, the steels of the present invention showed 0.09% or lower percent defective. In particular, the steels No. 26 through 28 and No. 33 through 35, which included B, improved the percent defective to 0.05% or less.

The percent defective caused by blistering was further investigated by changing the heating rate during continuous annealing or continuous hot dip galvanizing. Table 4 shows the heating rate at lower temperature zone and at higher temperature zone, and the inflection point of heating curve for both the steels of the present invention and the comparative steels. Table 5 lists the percent defective of the steels No. 20, 27, 29, and 33 at each heating rate. FIG. 4 shows the percent defective under various heating rates. The horizontal axis is the heating rate at high temperature zone, and the vertical axis is the heating rate at low temperature zone. The steels treated by the heating rate of 20° C./ sec or more at low temperature zone and of 1°-5° C./sec at higher temperature zone further reduced their percent defective, compared with the steels treated by the heating rate out of the above specific range, which validated the effect of the invention.

Figure 5:
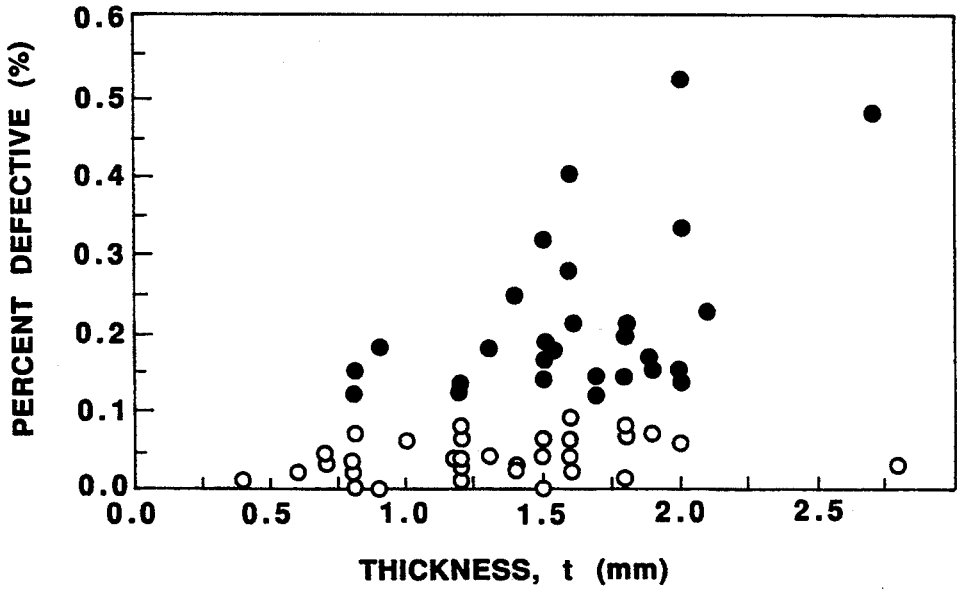
FIG. 5 is a graph which shows the relation between steel sheet thickness of the present invention and percent defective caused by blistering.

FIG. 5 shows the relation between the steel sheet thickness of the present invention and percent defective caused by blistering. In the figure, the symbol ○ designates the steels No. 1 through 35 of the present invention, and the symbol ● designates the comparative steels No. 36 through 65. The comparative steels increase the frequency of blister generation with the increase of sheet thickness. On the contrary, the steel sheets of the present invention keep the frequency of blister generation at a very low level even with a thick sheet. Thus, the remarkable effect of the present invention is confirmed.

TABLE 1

| | C | Mn | Si | P | S | Nb | Ti | B | sol.Al | N | O | *1 | *2 |
|---|---|---|---|---|---|---|---|---|---|---|---|---|---|
| 1 | 0.0025 | 0.12 | 0.03 | 0.015 | 0.0061 | 0.005 | 0.045 | 0.0000 | 0.020 | 0.0020 | 0.0025 | 0.0160 | 0.0560 |
| 2 | 0.0029 | 0.10 | 0.02 | 0.013 | 0.0226 | 0.012 | 0.004 | 0.0000 | 0.032 | 0.0032 | 0.0006 | 0.0449 | 0.0913 |
| 3 | 0.0018 | 0.15 | 0.05 | 0.009 | 0.0082 | 0.015 | 0.005 | 0.0000 | 0.025 | 0.0016 | 0.0016 | 0.0178 | 0.0466 |
| 4 | 0.0023 | 0.23 | 0.04 | 0.012 | 0.0086 | 0.011 | 0.011 | 0.0000 | 0.042 | 0.0014 | 0.0023 | 0.0177 | 0.0545 |
| 5 | 0.0016 | 0.20 | 0.01 | 0.015 | 0.0022 | 0.003 | 0.009 | 0.0000 | 0.055 | 0.0014 | 0.0018 | 0.0081 | 0.0337 |
| 6 | 0.0020 | 0.15 | 0.01 | 0.019 | 0.0019 | 0.016 | 0.012 | 0.0000 | 0.023 | 0.0011 | 0.0005 | 0.0066 | 0.0386 |
| 7 | 0.0018 | 0.14 | 0.01 | 0.014 | 0.0023 | 0.014 | 0.015 | 0.0000 | 0.021 | 0.0017 | 0.0017 | 0.0093 | 0.0381 |
| 8 | 0.0010 | 0.13 | 0.02 | 0.011 | 0.0020 | 0.015 | 0.010 | 0.0000 | 0.053 | 0.0010 | 0.0014 | 0.0064 | 0.0224 |
| 9 | 0.0010 | 0.12 | 0.00 | 0.016 | 0.0030 | 0.012 | 0.015 | 0.0000 | 0.060 | 0.0010 | 0.0012 | 0.0079 | 0.0239 |
| 10 | 0.0015 | 0.28 | 0.01 | 0.010 | 0.0066 | 0.018 | 0.005 | 0.0000 | 0.052 | 0.0020 | 0.0016 | 0.0168 | 0.0408 |
| 11 | 0.0019 | 0.12 | 0.02 | 0.008 | 0.0086 | 0.030 | 0.009 | 0.0000 | 0.042 | 0.0022 | 0.0021 | 0.0204 | 0.0508 |
| 12 | 0.0021 | 0.20 | 0.02 | 0.020 | 0.0093 | 0.025 | 0.012 | 0.0000 | 0.046 | 0.0012 | 0.0026 | 0.0181 | 0.0517 |
| 13 | 0.0011 | 0.17 | 0.01 | 0.016 | 0.0128 | 0.021 | 0.010 | 0.0000 | 0.025 | 0.0015 | 0.0027 | 0.0243 | 0.0419 |
| 14 | 0.0014 | 0.10 | 0.03 | 0.015 | 0.0114 | 0.024 | 0.013 | 0.0000 | 0.036 | 0.0016 | 0.0020 | 0.0226 | 0.0450 |
| 15 | 0.0020 | 0.18 | 0.04 | 0.013 | 0.0065 | 0.015 | 0.004 | 0.0000 | 0.034 | 0.0016 | 0.0015 | 0.0152 | 0.0472 |
| 16 | 0.0019 | 0.17 | 0.02 | 0.015 | 0.0088 | 0.008 | 0.025 | 0.0000 | 0.042 | 0.0021 | 0.0030 | 0.0171 | 0.0475 |
| 17 | 0.0018 | 0.13 | 0.02 | 0.014 | 0.0053 | 0.012 | 0.034 | 0.0000 | 0.046 | 0.0016 | 0.0022 | 0.0134 | 0.0422 |
| 18 | 0.0013 | 0.14 | 0.03 | 0.016 | 0.0087 | 0.010 | 0.028 | 0.0000 | 0.035 | 0.0015 | 0.0026 | 0.0182 | 0.0390 |
| 19 | 0.0022 | 0.12 | 0.01 | 0.019 | 0.0058 | 0.009 | 0.017 | 0.0000 | 0.033 | 0.0016 | 0.0016 | 0.0142 | 0.0494 |
| 20 | 0.0013 | 0.16 | 0.05 | 0.017 | 0.0126 | 0.004 | 0.033 | 0.0000 | 0.023 | 0.0018 | 0.0024 | 0.0251 | 0.0459 |
| 21 | 0.0016 | 0.19 | 0.02 | 0.017 | 0.0072 | 0.005 | 0.028 | 0.0000 | 0.036 | 0.0014 | 0.0002 | 0.0156 | 0.0412 |
| 22 | 0.0011 | 0.15 | 0.03 | 0.015 | 0.0056 | 0.006 | 0.024 | 0.0000 | 0.041 | 0.0017 | 0.0018 | 0.0142 | 0.0318 |
| 23 | 0.0012 | 0.17 | 0.01 | 0.018 | 0.0053 | 0.012 | 0.032 | 0.0000 | 0.056 | 0.0015 | 0.0016 | 0.0131 | 0.0323 |
| 24 | 0.0006 | 0.16 | 0.01 | 0.010 | 0.0065 | 0.016 | 0.021 | 0.0000 | 0.046 | 0.0018 | 0.0021 | 0.0159 | 0.0255 |
| 25 | 0.0019 | 0.16 | 0.02 | 0.011 | 0.0067 | 0.018 | 0.024 | 0.0000 | 0.052 | 0.0019 | 0.0012 | 0.0166 | 0.0470 |
| 26 | 0.0018 | 0.12 | 0.03 | 0.010 | 0.0035 | 0.018 | 0.008 | 0.0003 | 0.042 | 0.0013 | 0.0015 | 0.0097 | 0.0385 |
| 27 | 0.0015 | 0.15 | 0.01 | 0.016 | 0.0041 | 0.021 | 0.026 | 0.0009 | 0.023 | 0.0022 | 0.0023 | 0.0137 | 0.0377 |
| 28 | 0.0014 | 0.16 | 0.02 | 0.013 | 0.0043 | 0.009 | 0.042 | 0.0012 | 0.051 | 0.0043 | 0.0020 | 0.0212 | 0.0436 |
| 29 | 0.0014 | 0.14 | 0.02 | 0.015 | 0.0072 | 0.000 | 0.019 | 0.0000 | 0.036 | 0.0013 | 0.0022 | 0.0153 | 0.0377 |
| 30 | 0.0016 | 2.05 | 0.53 | 0.022 | 0.0032 | 0.000 | 0.008 | 0.0000 | 0.025 | 0.0016 | 0.0020 | 0.0103 | 0.0359 |
| 31 | 0.0014 | 0.14 | 0.05 | 0.012 | 0.0096 | 0.000 | 0.036 | 0.0000 | 0.038 | 0.0015 | 0.0018 | 0.0195 | 0.0419 |
| 32 | 0.0018 | 0.17 | 0.03 | 0.016 | 0.0053 | 0.000 | 0.025 | 0.0000 | 0.041 | 0.0012 | 0.0016 | 0.0121 | 0.0409 |
| 33 | 0.0017 | 0.18 | 0.01 | 0.013 | 0.0086 | 0.000 | 0.025 | 0.0005 | 0.042 | 0.0019 | 0.0026 | 0.0194 | 0.0466 |
| 34 | 0.0018 | 1.21 | 0.23 | 0.060 | 0.0043 | 0.000 | 0.042 | 0.0011 | 0.053 | 0.0023 | 0.0025 | 0.0143 | 0.0431 |
| 35 | 0.0013 | 0.15 | 0.12 | 0.014 | 0.0040 | 0.000 | 0.015 | 0.0003 | 0.044 | 0.0031 | 0.0023 | 0.0166 | 0.0374 |

TABLE 2

| | C | Mn | Si | P | S | Nb | Ti | B | sol.Al | N | O | *1 | *2 |
|---|---|---|---|---|---|---|---|---|---|---|---|---|---|
| 36 | 0.0004* | 0.13 | 0.03 | 0.015 | 0.0078 | 0.019 | 0.023 | 0.0000 | 0.033 | 0.0021 | 0.0024 | 0.0189 | 0.0253 |
| 37 | 0.0015 | 0.21 | 0.03 | 0.016 | 0.0042 | 0.011 | 0.018 | 0.0000 | 0.028 | 0.0014 | 0.0040* | 0.0111 | 0.0351 |
| 38 | 0.0032 | 0.20 | 0.02 | 0.013 | 0.0087 | 0.017 | 0.044 | 0.0010 | 0.027 | 0.0025 | 0.00361 | 0.0217 | 0.0729 |
| 39 | 0.0017 | 0.15 | 0.01 | 0.018 | 0.0058 | 0.008 | 0.037 | 0.0000 | 0.039 | 0.0038 | 0.0033* | 0.0217 | 0.0489 |
| 40 | 0.0017 | 0.16 | 0.02 | 0.012 | 0.0104 | 0.010 | 0.007* | 0.0000 | 0.041 | 0.0021 | 0.0009 | 0.0228 | 0.0500 |
| 41 | 0.0024 | 0.15 | 0.01 | 0.014 | 0.0043 | 0.013 | 0.0051 | 0.0000 | 0.031 | 0.0010 | 0.0021 | 0.0099 | 0.0483 |
| 42 | 0.0015 | 0.13 | 0.01 | 0.017 | 0.0174 | 0.015 | 0.004* | 0.0000 | 0.038 | 0.0028 | 0.0018 | 0.0357 | 0.0597 |
| 43 | 0.0012 | 0.18 | 0.02 | 0.016 | 0.0117 | 0.014 | 0.006* | 0.0000 | 0.053 | 0.0015 | 0.0013 | 0.0227 | 0.0419 |
| 44 | 0.0024 | 0.20 | 0.01 | 0.013 | 0.0069 | 0.016 | 0.010* | 0.0000 | 0.026 | 0.0032 | 0.0020 | 0.0213 | 0.0597 |
| 45 | 0.0022 | 0.22 | 0.01 | 0.015 | 0.0095 | 0.016 | 0.007* | 0.0000 | 0.034 | 0.0023 | 0.0023 | 0.0221 | 0.0573 |
| 46 | 0.0019 | 0.13 | 0.03 | 0.012 | 0.0042 | 0.012 | 0.0041 | 0.0000 | 0.032 | 0.0020 | 0.0013 | 0.0132 | 0.0434 |
| 47 | 0.0023 | 0.22 | 0.01 | 0.016 | 0.0054 | 0.018 | 0.028 | 0.0000 | 0.042 | 0.0018 | 0.0019 | 0.0143* | 0.0511 |
| 48 | 0.0013 | 0.16 | 0.02 | 0.014 | 0.0024 | 0.015 | 0.018 | 0.0000 | 0.048 | 0.0012 | 0.0020 | 0.0077* | 0.0285 |
| 49 | 0.0016 | 0.15 | 0.40 | 0.013 | 0.0013 | 0.014 | 0.022 | 0.0000 | 0.026 | 0.0011 | 0.0006 | 0.0057 | 0.0313 |
| 50 | 0.0021 | 0.16 | 0.04 | 0.015 | 0.0020 | 0.016 | 0.036 | 0.0000 | 0.025 | 0.0015 | 0.0015 | 0.0081* | 0.0417 |
| 51 | 0.0016 | 0.19 | 0.05 | 0.017 | 0.0035 | 0.014 | 0.016 | 0.0000 | 0.036 | 0.0016 | 0.0026 | 0.0107* | 0.0363 |
| 52 | 0.0013 | 0.11 | 0.02 | 0.016 | 0.0033 | 0.014 | 0.025 | 0.0000 | 0.052 | 0.0012 | 0.0013 | 0.0091* | 0.0299 |
| 53 | 0.0017 | 0.14 | 0.02 | 0.016 | 0.0016 | 0.013 | 0.028 | 0.0000 | 0.035 | 0.0010 | 0.0010 | 0.0058* | 0.0330 |
| 54 | 0.0010 | 0.16 | 0.03 | 0.017 | 0.0078 | 0.012 | 0.042 | 0.0000 | 0.025 | 0.0016 | 0.0019 | 0.0172 | 0.0332* |
| 55 | 0.0013 | 0.13 | 0.01 | 0.015 | 0.0042 | 0.006 | 0.035 | 0.0000 | 0.046 | 0.0015 | 0.0023 | 0.0114 | 0.0322* |
| 56 | 0.0012 | 0.18 | 0.01 | 0.018 | 0.0055 | 0.013 | 0.038 | 0.0000 | 0.037 | 0.0014 | 0.0014 | 0.0131 | 0.0323* |
| 57 | 0.0015 | 0.12 | 0.03 | 0.013 | 0.0062 | 0.018 | 0.039 | 0.0000 | 0.026 | 0.0013 | 0.0006 | 0.0138 | 0.0378* |
| 58 | 0.0022 | 0.14 | 0.02 | 0.014 | 0.0055 | 0.019 | 0.052 | 0.0000 | 0.043 | 0.0019 | 0.0018 | 0.0148 | 0.0500* |
| 59 | 0.0013 | 0.13 | 0.04 | 0.012 | 0.0049 | 0.014 | 0.042 | 0.0000 | 0.032 | 0.0015 | 0.0023 | 0.0125 | 0.0333* |
| 60 | 0.0014 | 0.17 | 0.01 | 0.013 | 0.0052 | 0.020 | 0.056 | 0.0000 | 0.029 | 0.0012 | 0.0028 | 0.0119 | 0.0348* |
| 61 | 0.0015 | 0.16 | 0.02 | 0.011 | 0.0128 | 0.000 | 0.006* | 0.0000 | 0.045 | 0.0021 | 0.0021 | 0.0264 | 0.0504 |
| 62 | 0.0022 | 0.14 | 0.03 | 0.016 | 0.0024 | 0.000 | 0.033 | 0.0000 | 0.036 | 0.0011 | 0.0018 | 0.0074* | 0.0426 |
| 63 | 0.0023 | 1.42 | 0.22 | 0.020 | 0.0025 | 0.000 | 0.016 | 0.0000 | 0.052 | 0.0018 | 0.0022 | 0.0099* | 0.0467 |
| 64 | 0.0021 | 0.18 | 0.01 | 0.012 | 0.0085 | 0.000 | 0.012 | 0.0000 | 0.043 | 0.0025 | 0.0032 | 0.0213 | 0.0549 |

TABLE 2-continued

| | C | Mn | Si | P | S | Nb | Ti | B | sol.Al | N | O | *1 | *2 |
|---|---|---|---|---|---|---|---|---|---|---|---|---|---|
| 65 | 0.0020 | 0.17 | 0.04 | 0.009 | 0.0063 | 0.000 | 0.061 | 0.0000 | 0.026 | 0.0022 | 0.0019 | 0.0170 | 0.0490* |

TABLE 3

| | Steel sheet thickness t (mm) | $0.02t^2 + 0.003$ | Percent defective (%) |
|---|---|---|---|
| 1 | 1.2 | 0.0059 | 0.06 |
| 2 | 0.6 | 0.0037 | 0.02 |
| 3 | 0.7 | 0.0040 | 0.03 |
| 4 | 1.8 | 0.0095 | 0.01 |
| 5 | 1.4 | 0.0069 | 0.02 |
| 6 | 1.2 | 0.0059 | 0.01 |
| 7 | 1.5 | 0.0075 | 0.00 |
| 8 | 0.8 | 0.0043 | 0.00 |
| 9 | 1.0 | 0.0050 | 0.06 |
| 10 | 0.9 | 0.0046 | 0.00 |
| 11 | 1.6 | 0.0081 | 0.02 |
| 12 | 1.2 | 0.0059 | 0.04 |
| 13 | 0.8 | 0.0043 | 0.03 |
| 14 | 0.8 | 0.0043 | 0.02 |
| 15 | 0.4 | 0.0033 | 0.01 |
| 16 | 1.6 | 0.0081 | 0.09 |
| 17 | 0.8 | 0.0043 | 0.07 |
| 18 | 1.8 | 0.0095 | 0.08 |
| 19 | 1.4 | 0.0069 | 0.02 |
| 20 | 1.6 | 0.0081 | 0.06 |
| 21 | 1.0 | 0.0050 | 0.06 |
| 22 | 1.9 | 0.0102 | 0.07 |
| 23 | 1.5 | 0.0075 | 0.06 |
| 24 | 1.2 | 0.0059 | 0.06 |
| 25 | 1.3 | 0.0064 | 0.04 |
| 26 | 0.7 | 0.0040 | 0.04 |
| 27 | 1.2 | 0.0059 | 0.04 |
| 28 | 2.8 | 0.0187 | 0.03 |
| 29 | 2.0 | 0.0110 | 0.07 |
| 30 | 1.5 | 0.0075 | 0.05 |
| 31 | 1.2 | 0.0059 | 0.08 |
| 32 | 1.8 | 0.0095 | 0.08 |
| 33 | 1.4 | 0.0069 | 0.04 |
| 34 | 1.6 | 0.0081 | 0.05 |
| 35 | 1.2 | 0.0059 | 0.03 |
| 36 | 1.5 | 0.0075 | 0.32 |
| 37 | 1.6 | 0.0081 | 0.28 |
| 38 | 1.5 | 0.0075 | 0.16 |
| 39 | 1.8 | 0.0095 | 0.14 |
| 40 | 1.5 | 0.0075 | 0.14 |
| 41 | 1.3 | 0.0064 | 0.18 |
| 42 | 0.8 | 0.0043 | 0.12 |
| 43 | 2.0 | 0.0110 | 0.33 |
| 44 | 2.0 | 0.0110 | 0.13 |
| 45 | 1.8 | 0.0095 | 0.21 |
| 46 | 1.6 | 0.0081 | 0.40 |
| 47 | 2.7 | 0.0176 | 0.48 |
| 48 | 1.7 | 0.0088 | 0.14 |
| 49 | 1.2 | 0.0059 | 0.12 |
| 50 | 2.1 | 0.0118 | 0.23 |
| 51 | 2.0 | 0.0110 | 0.13 |
| 52 | 1.9 | 0.0102 | 0.15 |
| 53 | 1.5 | 0.0075 | 0.18 |
| 54 | 1.4 | 0.0069 | 0.25 |
| 55 | 0.8 | 0.0043 | 0.15 |
| 56 | 1.5 | 0.0075 | 0.17 |
| 57 | 1.7 | 0.0088 | 0.12 |
| 58 | 1.2 | 0.0059 | 0.13 |
| 59 | 0.9 | 0.0046 | 0.18 |
| 60 | 2.0 | 0.0110 | 0.52 |
| 61 | 1.5 | 0.0075 | 0.18 |
| 62 | 1.8 | 0.0095 | 0.19 |
| 63 | 1.9 | 0.0102 | 0.17 |
| 64 | 2.0 | 0.0110 | 0.16 |
| 65 | 1.6 | 0.0081 | 0.22 |

TABLE 4

| Condition | Heating rate at lower temperature zone (°C./sec) | Heating rate at higher temperature zone (°C./sec) | Inflection point on heating speed curve (°C.) |
|---|---|---|---|
| Example of this invention | | | |
| A | 20 | 1 | 700 |
| B | 20 | 2 | 650 |
| C | 20 | 5 | 680 |
| D | 30 | 2 | 720 |
| E | 50 | 1 | 700 |
| F | 50 | 2 | 700 |
| G | 50 | 5 | 700 |
| H | 75 | 2 | 700 |
| Comparative example | | | |
| I | 5 | 2 | 700 |
| J | 10 | 2 | 700 |
| K | 10 | 10 | 700 |
| L | 30 | 10 | 700 |

TABLE 5

| Condition | Steel No. 20 | Steel No. 27 | Steel No. 29 | Steel No. 33 |
|---|---|---|---|---|
| Example of this invention | | | | |
| A | 0.06 | 0.04 | 0.07 | 0.04 |
| B | 0.06 | 0.04 | 0.06 | 0.03 |
| C | 0.06 | 0.05 | 0.06 | 0.04 |
| D | 0.04 | 0.03 | 0.04 | 0.02 |
| E | 0.04 | 0.03 | 0.04 | 0.03 |
| F | 0.03 | 0.03 | 0.04 | 0.02 |
| G | 0.06 | 0.05 | 0.06 | 0.05 |
| H | 0.03 | 0.03 | 0.04 | 0.02 |
| Comparative example | | | | |
| I | 0.09 | 0.08 | 0.09 | 0.08 |
| J | 0.08 | 0.08 | 0.09 | 0.07 |
| K | 0.09 | 0.08 | 0.09 | 0.08 |
| L | 0.08 | 0.07 | 0.09 | 0.07 |

What is claimed is:

1. A blister-resistant steel sheet consisting essentially of:

0.0005 to 0.003 wt. % C, 0.10 to 2.2 wt. % Mn, 0.6 wt. % or less Si, 0.07 wt. % or less P, 0.025 wt. % or less S, 0.02 to 0.06 wt. % sol. Al, 0.0035 wt. % or less N, 0.003 wt. % or less O, [(48/14)N+(48/32)S+4×(48/12)C] wt. % or less Ti, and the balance being Fe and inevitable impurities; and smaller one of either Ti (wt. %) or [(48/14)N+(48/32)S] (wt. %) being [0.002 $t^2$+0.003] or more, where t is a thickness (mm) of the steel sheet.

2. The blister-resistant steel sheet of claim 1, wherein the steel sheet is a cold rolled steel sheet.

3. The blister-resistant steel sheet of claim 1, wherein the steel sheet is a surface treated steel sheet.

4. A blister-resistant steel sheet consisting essentially of:

0.0005 to 0.003 wt. % C, 0.10 to 2.2 wt. % Mn, 0.6 wt. % or less Si, 0.07 wt. % or less P, 0.025 wt. % or less S, 0.02 to 0.06 wt. % sol. Al, 0.0035 wt. % or less N, and 0.003 wt. % or less O, and at least one element selected from the group consisting of 0.003 to 0.03 wt. % Nb and 0.0003 to 0.0015 wt. % B, and [(48/14)N+(48/32)S+4×(48/12)C] wt. % or less Ti, and the balance being Fe and inevitable impurities; and smaller one of either Ti (wt. %) or [(48/14)N+(48/32)S] (wt. %) being [0.002 $t^2$+0.003] or more, where t is a thickness (ram) of the steel sheet.

5. The blister-resistant steel sheet of claim 4, wherein the steel sheet is a cold rolled steel sheet.

6. The blister-resistant steel sheet of claim 4, wherein the steel sheet is a surface treated steel sheet.

7. A method for producing a blister-resistant steel sheet comprising:

preparing a cold rolled steel sheet consisting essentially of 0.0005 to 0.003 wt. % C, 0.10 to 2.2 wt. % Mn, 0.6 wt. % or less Si, 0.07 wt. % or less P, 0.025 wt. % or less S, 0.02 to 0.06 wt. % sol. Al, 0.0035 wt. % or less N, 0.003 wt. % or less O, [(48/14)N+(48/32)S+4×(48/12)C] wt. % or less Ti, and the balance being Fe and inevitable impurities; and smaller one of either Ti (wt. %) or [(48/14)N+(48/32)S] (wt. %) being [0.002 $t^2$+0.003] or more, where t is a thickness (mm) of the blister resistant steel sheet;

continuously annealing the cold rolled steel sheet by heating the steel sheet from room temperature to 650°–720° C. at a rate of 20° C./sec or more and further to the soaking temperature above the recrystallization temperature at a rate of 1°–5° C./sec; and temper rolling the continuously annealed steel sheet.

8. The method of claim 7, wherein the step of preparing a cold rolled steel sheet includes preparing a cold rolled steel sheet consisting essentially of:

0.0005 to 0.003 wt. % C, 0.10 to 2.2 wt. % Mn, 0.6 wt. % or less Si, 0.07 wt. % or less P, 0.025 wt. % or less S, 0.02–0.06 wt. % sol. Al, 0.0035 wt. % or less N, and 0.003 wt. % or less O, and at least one element selected from the group consisting of 0.003 to 0.03 wt. % Nb and 0.0003 to 0.0015 wt. % B, [(48/14)N+(48/32)S+4×(48/12)C] wt. % or less Ti, and the balance being Fe and inevitable impurities; and smaller one of either Ti (wt. %) or [(48/14)N+(48/32)S] (wt. %) being [0.002 $t^2$+0.003] or more, where t is the thickness (mm) of the steel sheet.

9. A method for producing a blister-resistant zinc hot galvanizing steel sheet comprising:

preparing a cold rolled-steel sheet consisting essentially of 0.0005 to 0.003 wt. % C, 0.10 to 2.2 wt. % Mn, 0.6 wt. % or less Si, 0.07 wt. % or less P, 0.025 wt. % or less S, 0.02 to 0.06 wt. % sol. Al, 0.0035 wt. % or less N, 0.003 wt. % or less O, [(48/14)N+(48/32)S+4×(48/12)C] wt. % or less Ti, and the balance being Fe and inevitable impurities; and smaller one of either Ti (wt. %) or [(48/14)N+(48/32)S](wt. %) being [0.002$t^2$+0.003] or more, where t is a thickness (mm) of the steel sheet;

hot dip galvanizing continuously by heating the steel sheet from room temperature to 650°–720° C. at a rate of 20° C./sec or more and further to the soaking temperature above the recrystallization temperature at a rate of 1°–5° C./sec; and temper rolling the continuously hot dip galvanized steel sheet.

10. The method of claim 9, wherein the step of preparing the cold rolled steel sheet includes preparing a cold rolled steel sheet consisting essentially of:

0.0005 to 0.003 wt. % C, 0.10 to 2.2 wt. % Mn, 0.6 wt. % or less Si, 0.07 wt. % or less P, 0.025 wt. % or less S, 0.02 to 0.06 wt. % sol. A., 0.0035 wt. % or less N, and 0.003 wt. % or less O, at least one element selected from the group consisting of 0.003 to 0.03 wt. % Nb and 0.0003 to 0.0015 wt. % B, and [(48/14)N+(48/32)S+4×(48/12)C] wt. % or less Ti and the balance being Fe and inevitable impurities; and smaller one of either Ti (wt. %) or [(48/14)N+(48/32)S] (wt. %) being [0.002 $t^2$+0.003] or more, where t is the thickness (mm) of the steel sheet.

11. A method for producing a blister-resistant electroplated steel sheet comprising:

preparing a cold rolled steel sheet consisting essentially of 0.0005 to 0.003 wt. % C, 0.10 to 2.2 wt. % Mn, 0.6 wt. % or less Si, 0.07 wt. % or less P, 0.025 wt. % or less S, 0.02 to 0.06 wt. % of sol. Al, 0.0035 wt. % or less N, 0.003 wt. % or less O, [(48/14)N+(48/32)S+4×(48/12)C] wt. % or less Ti, and the balance being Fe and inevitable impurities; and smaller one of either Ti (wt. %) or [(48/14)N+(48/32)S] (wt. %) being [0.002 $t^2$+0.003] or more, where t is a thickness (mm) of the steel sheet;

continuously annealing the cold rolled steel sheet by heating the steel sheet from room temperature to 650°–720° C. at a rate of 20° C./sec or more and further to the soaking temperature above the recrystallization temperature at a rate of 1°–5 ° C./sec;

temper rolling the continuously annealed steel sheet: and electroplating the temper rolled steel sheet.

12. The method of claim 11, wherein the step of preparing the cold rolled steel sheet includes preparing a cold rolled steel sheet consisting essentially of;

0.0005 to 0.003 wt. % C., 0.10 to 2.2 wt. % Mn, 0.6 wt. % or less Si, O.07 wt. % or less P, 0.025 wt. % or less S, 0.02 to 0.06 wt. % sol. Al, 0.0035 wt. % or less N, and 0.003 wt. % or less O, and at least one element selected from the group consisting of 0.003 to 0.03 wt. % Nb and 0.0003 to 0.0015 wt. % B, and [(48/14)N+(48/32)S+4×(48/12)C] wt. % or less Ti and the balance being Fe and inevitable impurities; and smaller one of either Ti (wt. %) or [(48/14)N+(48/32)S] (wt. %) being [0.002 $t^2$+0.003] or more, where t is a thickness (mm) of the steel sheet.

13. The blister-resistant steel sheet of claim 1, wherein the oxygen is in an amount of 0.0002 to 0.003 wt. %.

14. The blister-resistant steel sheet of claim 5, wherein the oxygen is in an amount of 0.0002 to 0.003 wt. %.

15. The method of claim 7, wherein the oxygen is in an amount of 0.0002 to 0.003 wt. %.

16. The method of claim 9, wherein the oxygen is in an amount of 0.0002 to 0.003 wt. %.

17. The method of claim 11, wherein the oxygen is in an amount of 0.0002 to 0.003 wt. %.

18. The method of claim 7, wherein the soaking temperature is 760 to 870° C.

19. The method of claim 9, wherein the soaking temperature is 760 to 870° C.

20. The method of claim 11, wherein the soaking temperature is 760 to 870° C.

* * * * *